US009317008B2

(12) United States Patent
Handa et al.

(10) Patent No.: US 9,317,008 B2
(45) Date of Patent: Apr. 19, 2016

(54) IMAGE FORMING APPARATUS EMPLOYING CLEANERLESS SYSTEM

(71) Applicant: Brother Kogyo Kabushiki Kaisha, Nagoya-shi, Aichi-ken (JP)

(72) Inventors: Hiroshi Handa, Inazawa (JP); Takeshi Bito, Inazawa (JP); Hiroki Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/593,076

(22) Filed: Jan. 9, 2015

(65) Prior Publication Data

US 2015/0117903 A1 Apr. 30, 2015

Related U.S. Application Data

(63) Continuation-in-part of application No. PCT/JP2012/080845, filed on Nov. 29, 2012.

(30) Foreign Application Priority Data

Jul. 9, 2012 (JP) ..... 2012-154154

(51) Int. Cl.
*G03G 15/24* (2006.01)
*G03G 21/18* (2006.01)
*G03G 21/00* (2006.01)

(52) U.S. Cl.
CPC ..... *G03G 21/1814* (2013.01); *G03G 21/0064* (2013.01)

(58) Field of Classification Search
CPC ..... G03G 15/0898; G03G 21/0064
USPC ..... 399/103, 149, 150, 313
See application file for complete search history.

(56) References Cited

U.S. PATENT DOCUMENTS

| | | | | |
|---|---|---|---|---|
| 5,864,736 | A * | 1/1999 | Shimada et al. | 399/149 |
| 6,029,034 | A * | 2/2000 | Itsukushima et al. | 399/149 |
| 6,088,555 | A | 7/2000 | Mizuno | |
| 6,314,257 | B1 | 11/2001 | Ishii et al. | |
| 6,438,331 | B2 * | 8/2002 | Sakaizawa et al. | 399/149 |
| 6,839,530 | B2 * | 1/2005 | Takahashi et al. | 399/149 |

(Continued)

FOREIGN PATENT DOCUMENTS

| | | |
|---|---|---|
| JP | H06-148967 A | 5/1994 |
| JP | H08-194417 A | 7/1996 |

(Continued)

OTHER PUBLICATIONS

Jan. 22, 2015—(WO) Translation of the Int'l Prelim Report on Patentability—App PCT/JP2012/080845.

(Continued)

*Primary Examiner* — William J Royer
(74) *Attorney, Agent, or Firm* — Banner & Witcoff, Ltd.

(57) ABSTRACT

An image forming apparatus includes a developing roller and a photosensitive drum configured to rotate about a first axis, and has a peripheral surface. The developing roller is configured to contact the photosensitive drum and is configured to supply developer to the photosensitive drum by rotating about a second axis positioned lower than the first axis in a vertical direction to form a visible image on the peripheral surface. Extraneous matter on the peripheral surface is recovered only by the developing roller.

13 Claims, 3 Drawing Sheets

(56) References Cited

U.S. PATENT DOCUMENTS

| | | | |
|---|---|---|---|
| 7,113,199 | B2 | 9/2006 | Hattori |
| 8,374,523 | B2 | 2/2013 | Kato |
| 2004/0100547 | A1 | 5/2004 | Hattori |
| 2008/0145093 | A1 | 6/2008 | Fukuta et al. |
| 2011/0076049 | A1 | 3/2011 | Kato |
| 2011/0158682 | A1 | 6/2011 | Takagi et al. |

FOREIGN PATENT DOCUMENTS

| | | | |
|---|---|---|---|
| JP | H10-268734 | A | 10/1998 |
| JP | 2000-315014 | A | 11/2000 |
| JP | 2004-077799 | A | 3/2004 |
| JP | 2005-141019 | A | 6/2005 |
| JP | 2007-304447 | A | 11/2007 |
| JP | 2008-170936 | A | 7/2008 |
| JP | 2010-091981 | A | 4/2010 |
| JP | 2011-075653 | A | 4/2011 |
| JP | 2011-133759 | A | 7/2011 |

OTHER PUBLICATIONS

Nov, 24, 2015—(JP) Office Action—App 2012-154154, Eng Tran.
Feb. 9, 2016—(JP) Office Action—App 2012-154154, Eng Tran.

* cited by examiner

IMAGE FORMING APPARATUS EMPLOYING CLEANERLESS SYSTEM

CROSS REFERENCE TO RELATED APPLICATION

This application claims priority from Japanese Patent Application No. 2012-154154 filed Jul. 9, 2012. This application is also a continuation-in-part of International Application No. PCT/JP2012/080845 filed Nov. 29, 2012 in the Japanese Patent Office as a Receiving Office. The contents of these applications are incorporated herein by reference.

TECHNICAL FIELD

The present invention relates to an image-forming device employing an electrophotographic system.

BACKGROUND

One electrophotographic image-forming device known in the art is a printer, as described in Japanese Patent Application Publication No. H08-194417 (Patent Document 1), that comprises a photosensitive drum on which an electrostatic latent image is formed, a developing roller that confronts and contacts the photosensitive drum and supplies toner to the electrostatic latent image, and a cleaning blade that scrapes off extraneous matter (toner, for example) from the circumferential surface of the photosensitive drum that was deposited on the surface during image formation.

In this printer, the distal end of the cleaning blade contacts the circumferential surface of the photosensitive drum to scrape off extraneous matter deposited on the circumferential surface.

SUMMARY

However, since the distal end of the cleaning blade constantly contacts the circumferential surface of the photosensitive drum in the printer described in the Patent Document 1, the cleaning blade may scratch the surface of the photosensitive drum through numerous image-forming operations.

Therefore, it is an object of the present invention to provide an image-forming device capable of suitably removing and recovering extraneous matter from the circumferential surface of the photosensitive drum while suppressing scratching of the circumferential surface.

In order to attain the above and other objects, the invention provides an image forming apparatus including a developing roller and a photosensitive drum configured to rotate about a first axis and having a peripheral surface. The developing roller may be configured to contact the photosensitive drum and is configured to supply developer to the photosensitive drum by rotating about a second axis positioned lower than the first axis in a vertical direction to form a visible image on the peripheral surface. Extraneous matter on the peripheral surface may be recovered only by the developing roller.

DESCRIPTION OF THE PREFERRED EMBODIMENTS

1. Printer

Figure 1:
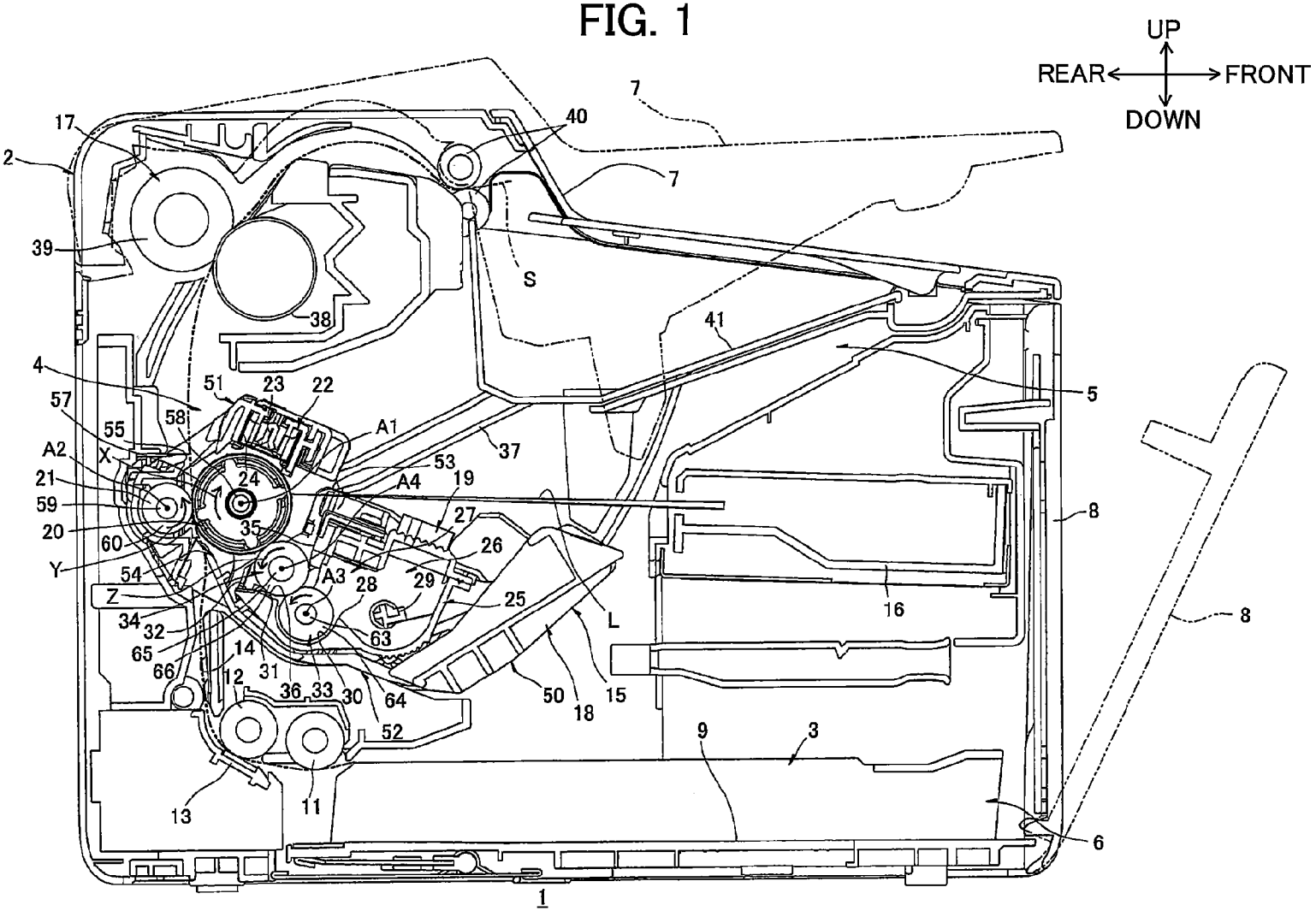
FIG. 1 is a cross-sectional view of a printer according to an embodiment of the present invention.

FIG. 1 shows a printer 1 serving as an example of an image forming apparatus that is provided with a main casing 2 having a box-like shape.

Within the main casing 2, the printer 1 is also provided with a sheet-feeding unit 3 for feeding sheets S (one example of a recording medium) of paper, and an image-forming unit 4 for forming images on the sheets S supplied by the sheet-feeding unit 3.

Directions will be specified based on orientations of these units when resting on a level surface, and specifically will refer to the directions indicated by arrows in the drawings. The right side of FIG. 1 is referred to as front, and the left side as rear; and the back side of the paper surface is referred to as right, and the front side of the paper surface as left. In this manner, each of the directions is indicated. In this case, the left and the right are defined based on the directions when the printer 1 is viewed from the front side. Incidentally, the frontward/rearward direction and the leftward/rightward direction are respectively referred to as the horizontal direction and the vertical direction.

(1) Main Casing

Formed in the main casing 2 are a cartridge access opening 5 for mounting and removing a process cartridge 15 (described later), and a paper-introducing opening 6 through which the sheets S of paper are inserted into the main casing 2.

The cartridge access opening 5 is formed in an upper end portion of the main casing 2, penetrating the main casing 2 vertically.

The paper-introducing opening 6 is formed in a bottom portion on a front end portion of the main casing 2 and penetrates the front end portion in a frontward/rearward direction.

The main casing 2 also includes a top cover 7 disposed on the upper end portion thereof, and a sheet-feeding cover 8 disposed on the front end portion thereof. The top cover 7 is provided with a discharge tray 41.

The top cover 7 is disposed so as to be capable of pivoting (moving) about its rear edge portion between a closed position for covering the cartridge access opening 5, and an open position for exposing the cartridge access opening 5 (see two-dot chain lines in FIG. 1).

The sheet-feeding cover 8 is disposed so as to be capable of pivoting (moving) about its bottom edge portion between a first position for covering the paper-introducing opening 6, and a second position for exposing the paper-introducing opening 6 (see two-dot chain lines in FIG. 1).

(2) Sheet-Feeding Unit

The sheet-feeding unit 3 includes a sheet-supporting part 9 provided in a lower portion of the main casing 2.

The sheet-supporting part 9 is in communication with the exterior of the main casing 2 through the paper-introducing opening 6.

The sheets S of paper are placed in the sheet-feeding unit 3 when the sheet-feeding cover 8 is in its second position. More specifically, the sheets S are inserted through the paper-introducing opening 6 such that rear portions of the sheets S are stacked in the sheet-supporting part 9 and front portions of the sheets S are stacked on a top surface of the sheet-feeding cover 8.

The sheet-feeding unit 3 further includes a pickup roller 11 disposed above a rear edge portion of the sheet-supporting part 9, a feeding roller 12 disposed rearward of the pickup roller 11, a feeding pad 13 arranged to confront the lower rear side of the feeding roller 12, and a feeding path 14 extending continuously upward from a rear edge of the feeding pad 13.

(3) Image-Forming Unit

The image-forming unit 4 includes the process cartridge 15, a scanning unit 16 as an example of an exposing device, and a fixing unit 17.

(3-1-1) Process Cartridge

The process cartridge 15 is detachably mounted in the main casing 2. When mounted in the main casing 2, the process cartridge 15 is arranged above a rear portion of the sheet-feeding unit 3.

The process cartridge 15 includes a drum cartridge 18 and a developing cartridge 19 that is detachably mounted in the drum cartridge 18.

(3-1-1) Drum Cartridge

Figure 2:
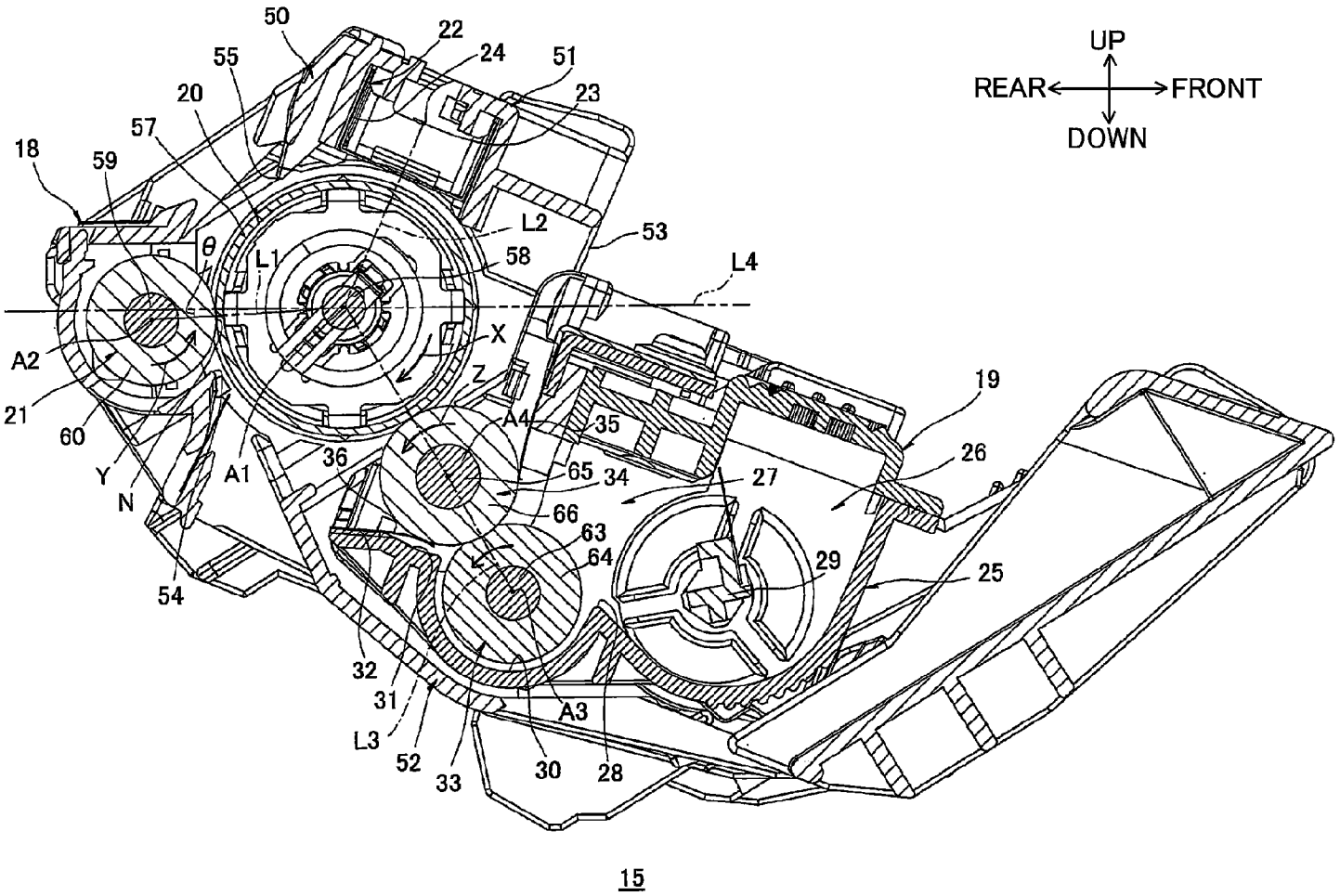
FIG. 2 is a cross-sectional view of a process cartridge (mounted in a main casing) shown in FIG. 1 as viewed in a horizontal direction.

As shown in FIG. 2, the drum cartridge 18 is provided with a drum frame 50.

The rear portion of the drum frame 50 is formed as a drum-accommodating section 51, and the front portion of the drum frame 50 is formed as a cartridge-mounting section 52.

The drum-accommodating section 51 is formed in a box-like shape that is elongated in the leftward/rightward direction and open on the front side. The open front side of the drum-accommodating section 51 is defined as a drum opening 53 and serves as an example of an exposure opening (see FIG. 1).

The drum-accommodating section 51 accommodates a photosensitive drum 20, a transfer roller 21, and a scorotron charger 22 serving as an example of a charger in the invention.

The photosensitive drum 20 includes a drum body 57 and a drum shaft 58.

The drum body 57 includes a metal tube formed in a general cylindrical shape whose axis is aligned in the leftward/rightward direction, and a resinous photosensitive layer covering the surface of the metal tube.

The drum shaft 58 is formed of metal and has a general columnar shape, with its axis oriented in the leftward/rightward direction. The leftward/rightward dimension of the drum shaft 58 is greater than the leftward/rightward dimension of the drum body 57. The drum shaft 58 is rotatably inserted inside the drum body 57 such that its central axis is aligned with the central axis of the drum body 57.

The photosensitive drum 20 is provided in the approximate center region of the drum-accommodating section 51 such that the circumferential surface of the drum body 57 positioned on the front side is exposed through the drum opening 53.

The left and right ends of the drum shaft 58 are supported by the drum-accommodating section 51, and therefore the photosensitive drum 20 is capable of rotating about the central axis A1 of the drum body 57 (an example of a first axis).

In an image-forming operation (described later), a drive force is transmitted to the drum body 57 from a motor or other drive source (not shown) provided in the main casing 2 for driving the drum body 57 to rotate in a rotating direction X (clockwise in a left side view) indicated by the arrow in the drawings.

The transfer roller 21 includes a metal transfer-roller shaft 59 whose axis is oriented in the leftward/rightward direction, and a roller body 60 that covers the transfer-roller shaft 59 while leaving the left and right ends of the transfer-roller shaft 59 exposed. The roller body 60 is formed of an electrically conductive rubber or an electrically conductive sponge.

The transfer roller 21 is provided in the rear portion of the drum-accommodating section 51 such that the roller body 60 contacts and presses the rear side of the drum body 57.

Figure 3:
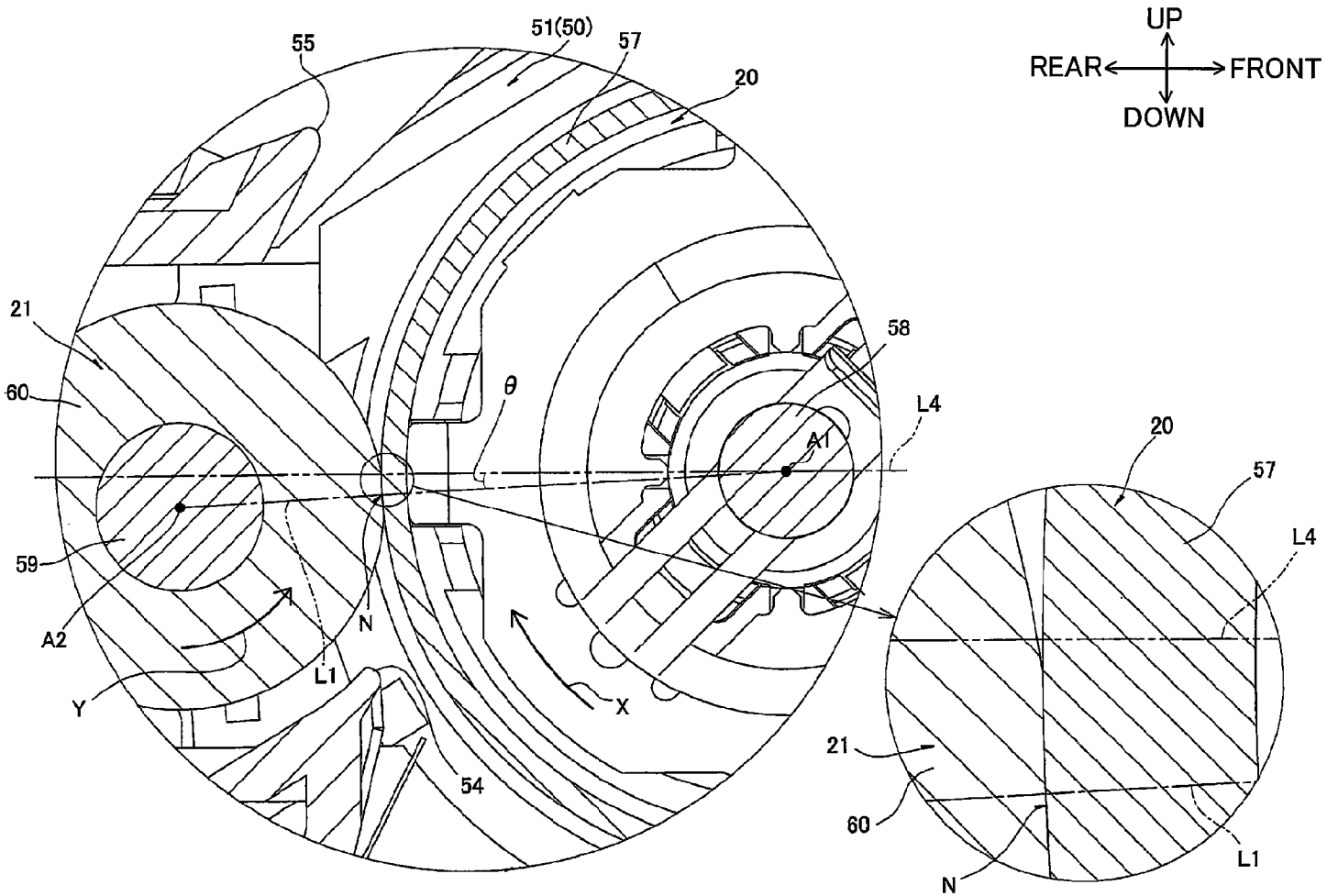
FIG. 3 is an enlarged view showing a main portion of a contacting part between a transfer roller and a developing roller shown in the FIG. 2.

As shown in FIG. 3, the transfer roller 21 is disposed on the rearward of the photosensitive drum 20 such that its central axis A2 (described later) is positioned slightly lower than the central axis A1 of the photosensitive drum 20. However, as illustrated in FIG. 2, the bottom surface of the transfer roller 21 is positioned higher than the bottom surface of the photosensitive drum 20.

Accordingly, the weight of the transfer roller 21 has no influence on the amount of pressure with which the transfer roller 21 presses against the photosensitive drum 20 (transfer pressure).

That is, as shown in FIG. 3, a virtual line segment L1 connecting the central axis A2 (described later) of the transfer roller 21 to the central axis A1 of the photosensitive drum 20 forms an acute angle θ with a virtual line L4 extending horizontally in the frontward/rearward direction and passing through the central axis A1 of the photosensitive drum 20. The acute angle θ can be set greater or equal to 0 (zero) degrees and smaller or equal to 10 degrees, for example, and preferably approximately 3 degrees.

As shown in FIG. 1, this arrangement allows sheets S to be supplied to a contacting part N (see FIG. 3) between the roller body 60 of the transfer roller 21 and the drum body 57 of the photosensitive drum 20 and to convey the sheets S slightly forward as the sheets S that passed the contacting part N moves in an upward direction toward the fixing unit 17 (to a position between a heating roller 38 and a pressure roller 39 described later). The contacting part N is an example of a contact portion in the invention.

As shown in FIG. 3, the entire contacting part N between the roller body 60 and drum body 57 is positioned below the virtual line L4, i.e., lower than the central axis A1 of the photosensitive drum 20.

As shown in FIG. 2, the transfer roller 21 is rotatable about its central axis A2 (an example of a third axis), with the left and right ends of the transfer-roller shaft 59 supported in the drum-accommodating section 51.

In an image-forming operation (described later), friction between the roller body 60 and drum body 57 when the photosensitive drum 20 is driven to rotate causes the transfer roller 21 to follow this rotation in a rotating direction Y indicated by the arrow in FIG. 2 and FIG. 3. (counterclockwise in a left side view). When an image is being formed (described later), a power supply (not shown) provided in the main casing 2 applies a transfer bias (−2000 V (volts), for example) to the transfer-roller shaft 59 of the transfer roller 21.

The scorotron charger 22 includes a charging wire 23 (see FIG. 1), and a grid 24.

The charging wire 23 is arranged in a taut state to extend in the leftward/rightward direction and is disposed so as to confront but remain separated from the upper front side of the photosensitive drum 20.

The grid 24 is formed to have a general U-shape in a side view and is provided with the opening of the U-shape facing diagonally upward and forward so as to surround the lower and the rear portions of the charging wire 23.

The scorotron charger 22 is provided in the top portion of the drum-accommodating section 51 on the position upward and frontward of the photosensitive drum 20 such that the bottom portion of the grid 24 confronts but is separated from the circumferential surface of the drum body 57. Thus, the scorotron charger 22 is positioned higher than the central axis A1 and confronts the photosensitive drum 20 with a gap formed therebetween.

More specifically, the scorotron charger 22 is disposed away from the transfer roller 21 along the circumferential direction of the photosensitive drum 20 (the drum body 57). The scorotron charger 22 is disposed such that the virtual line segment L1 connecting the central axis A1 of the photosensitive drum 20 to the central axis A2 of the transfer roller 21 forms an angle of approximately 120 degrees with a virtual line segment L2 connecting the central axis A1 of the photosensitive drum 20 to the charging wire 23.

A paper feed opening 54 and a paper discharge opening 55 are also formed in the drum-accommodating section 51. Sheets S are fed through the paper feed opening 54 to the contacting part N between the roller body 60 and the drum body 57 and are discharged through the paper discharge opening 55 after passing through the contacting part N.

The paper feed opening 54 is formed in the bottom of the drum-accommodating section 51 at a position downward and forward of the contacting part N and vertically penetrates the drum-accommodating section 51 in the generally frontward/rearward center region thereof.

The paper discharge opening 55 is formed in the upper portion of the drum-accommodating section 51 at a position upward and forward of the contacting part N and vertically penetrates the drum-accommodating section 51 in its rear portion, and specifically rearward of the scorotron charger 22. Hence, the paper discharge opening 55 is formed between the scorotron charger 22 and transfer roller 21 in the circumferential direction of the drum body 57.

The cartridge-mounting section 52 has a box-like shape that forms open ends positioned rearward and upward thereof to allow mounting and removal of the developing cartridge 19. The cartridge-mounting section 52 is in communication with the drum-accommodating section 51 via the drum opening 53.

The rear end portion of the cartridge-mounting section 52 is coupled to the front end portion of the drum-accommodating section 51, and the cartridge-mounting section 52 is arranged so as to slope downward toward the front.

(3-1-2) Developing Cartridge

The developing cartridge 19 is detachably mounted on the cartridge-mounting section 52 of the drum cartridge 18, and is positioned downward and frontward of the photosensitive drum 20.

The developing cartridge 19 also includes a developing-cartridge frame 25.

The developing-cartridge frame 25 is formed in a box-like shape that is elongated in the leftward/rightward direction. A toner-accommodating chamber 26 and a development chamber 27 are formed in the developing-cartridge frame 25. The toner-accommodating chamber 26 and the development chamber 27 are aligned in the frontward/rearward direction, with a communication opening 28 allowing communication therebetween. The toner-accommodating chamber 26 and the development chamber 27 have substantially the same capacity.

The toner-accommodating chamber 26 accommodates toner (an example of a developer). An agitator 29 is provided in the generally frontward/rearward and vertical center region of the toner-accommodating chamber 26. In other words, the agitator 29 is positioned lower than the photosensitive drum 20.

The top surface on the bottom wall of the development chamber 27 forms a supply-roller groove 30, a developing-roller opposing surface 31, and a lower-film adhering surface 32.

The supply-roller groove 30 is formed in a general semi-circular shape conforming to a circumferential surface of a supply roller 33 (described later), with the convex shape of the supply-roller groove 30 facing obliquely downward and rearward.

The developing-roller opposing surface 31 is formed in a generally arc shape that conforms to the circumferential surface of a developing roller 34 (described later). The developing-roller opposing surface 31 extends continuously in a direction upward and rearward from the rear portion of the supply-roller groove 30.

The lower-film adhering surface 32 is formed continuously with the rear end portion of the developing-roller opposing surface 31 and extends in a direction sloping slightly upward toward the rear. Thus, the lower-film adhering surface 32 is arranged higher than the developing-roller opposing surface 31.

The lower-film adhering surface 32 is also arranged so as to vertically confront the bottom portion of the drum body 57 constituting the photosensitive drum 20 with a gap formed therebetween. The lower-film adhering surface 32 is arranged to overlap the central axis A1 of the photosensitive drum 20 when viewed in the vertical direction.

The supply roller 33, the developing roller 34, a thickness-regulating blade 35, and a lower film 36 as an example of a film member are provided in the development chamber 27.

The supply roller 33 is provided with a metal supply-roller shaft 63 oriented in the leftward/rightward direction, and an electrically conductive sponge roller 64 that covers the supply-roller shaft 63 while leaving the left and right ends of the supply-roller shaft 63 exposed.

The supply roller 33 is disposed on the rear side of the toner-accommodating chamber 26 with its bottom portion arranged in the supply-roller groove 30. The supply roller 33 is positioned at the same approximate height as the toner-accommodating chamber 26.

The supply roller 33 is arranged in the front portion of the development chamber 27 with the left and right ends of the supply-roller shaft 63 supported in the developing-cartridge frame 25 and is rotatable about its central axis A3.

During image formation (described later), a drive source (not shown) such as a motor provided in the main casing 2 transmits a drive force to the supply roller 33. The supply roller 33 is driven to rotate in the rotating direction indicated by the arrow in FIG. 2 (counterclockwise in a left side view) such that the portion of the supply roller 33 confronting and contacting the developing roller 34 (described later) moves in the opposite direction as the developing roller 34. Also during image formation, a power supply (not shown) provided in the main casing 2 applies a supply bias (+400 V (volts), for example) to the supply-roller shaft 63 of the supply roller 33.

The developing roller 34 is provided with a metal developing-roller shaft 65 oriented in the leftward/rightward direction and an electrically conductive rubber roller 66. The rubber roller 66 covers the developing-roller shaft 65 while leaving the left and right ends of the developing-roller shaft 65 exposed.

The developing roller 34 is arranged such that the lower circumferential surface of the rubber roller 66 opposes the developing-roller opposing surface 31 yet remains separated therefrom.

The developing roller 34 is also disposed so as to contact the upper rear side of the supply roller 33 and so that its top and rear side surfaces are exposed outside of the development chamber 27 and contact the lower front surface of the drum body 57 comprising the photosensitive drum 20. In other words, the developing roller 34 is arranged on the upper rear side of the supply roller 33 and the lower front side of the photosensitive drum 20 so as to be sandwiched between the two. That is, the supply roller 33 is disposed on the opposite side of the developing roller 34 from the photosensitive drum 20.

Further, the developing roller 34 is arranged such that its central axis A4 (described later) is lower than the central axis A1 of the photosensitive drum 20. The central axis A1 of the photosensitive drum 20, central axis A4 of the developing roller 34, and central axis A3 of the supply roller 33 are generally all aligned on the same virtual line L3 that follows a radial direction of the drum body 57.

The developing roller 34 is also disposed in a position separated from the scorotron charger 22 along the circumferential direction of the drum body 57. More specifically, the developing roller 34 is arranged such that the virtual line segment L2 connecting the central axis A1 of the photosensitive drum 20 to the charging wire 23 forms an angle of approximately 120 degrees with the virtual line L3 connecting the central axis A1 of the photosensitive drum 20 to the central axis A4 of the developing roller 34. Hence, the developing roller 34, scorotron charger 22, and transfer roller 21 are arranged at substantially equal intervals along the circumferential direction of the drum body 57. It is noted that only the rubber roller 66 of the developing roller 34 and the roller body 60 of the transfer roller 21 are in contact with the drum body 57.

The developing roller 34 is arranged in the rear portion of the development chamber 27, with the left and right ends of the developing-roller shaft 65 supported in the developing-cartridge frame 25 and is rotatable about the central axis A4 (an example of a second axis).

During an image-forming operation (described later), a drive source (not shown) such as a motor provided in the main casing 2 transmits a drive force to the developing roller 34. From this drive force, the developing roller 34 is driven to rotate in a rotating direction Z indicated by an arrow in FIG. 2 (counterclockwise in a left side view).

Note that the circumferential velocity of the developing roller 34 is 1.35 to 1.65 times larger than the circumferential velocity of the photosensitive drum 20 (the drum body 57), for example, and preferably 1.5 times larger than the circumferential velocity of the photosensitive drum 20.

During image formation (described later), a power supply (not shown) provided in the main casing 2 applies a developing bias (+300 V (volts), for example) to the developing-roller shaft 65 of the developing roller 34.

The upper end portion of the thickness-regulating blade 35 is fixed to the rear end portion of the top wall defining the development chamber 27. The bottom end portion of the thickness-regulating blade 35 contacts the circumferential surface of the rubber roller 66 from the front side thereof.

The lower portion of the lower film 36 is fixed to the lower-film adhering surface 32. The front end portion of the lower film 36 contacts the circumferential surface of the rubber roller 66 upward of the developing-roller opposing surface 31. Consequently, the rear edge of the lower film 36 is higher than the front edge of the lower film 36.

The lower film 36 is disposed below the photosensitive drum 20 such that its rear portion overlaps the central axis A1 of the photosensitive drum 20 in a vertical projection.

(3-2) Scanning Unit

As shown in FIG. 1, the scanning unit 16 is arranged frontward of the process cartridge 15 in a position opposing but separated from the photosensitive drum 20 in the frontward/rearward direction.

The scanning unit 16 irradiates a laser beam L (an example of a laser light) based on image data, thereby exposing the circumferential surface of the photosensitive drum 20.

More specifically, the scanning unit 16 irradiates the laser beam L rearward to expose the circumferential surface of the photosensitive drum 20 on the front side thereof. In other words, the exposure point at which the photosensitive drum 20 is exposed (the circumferential surface on the front side of the photosensitive drum 20) is configured to be on the opposite side of the central axis A1 of the photosensitive drum 20 from the contacting part N in which the photosensitive drum 20 and transfer roller 21 contact each other.

At this time, the developing cartridge 19 is arranged beneath the path of the irradiated laser beam L, while the scorotron charger 22 is arranged above the irradiated path of the laser beam L.

Guide parts 37 are provided on inner surfaces of the main casing 2 opposing the space between the scanning unit 16 and photosensitive drum 20 for guiding mounting and removal of the process cartridge 15. When removing the process cartridge 15 from the main casing 2, the guide parts 37 guide the process cartridge 15 so that the developing cartridge 19 mounted in the drum cartridge 18 moves upward, passing through the irradiation path of the laser beam L.

At this time, the various rollers provided in the process cartridge 15 (the transfer roller 21, supply roller 33, and developing roller 34) also pass upward through the irradiation path of the laser beam L.

(3-3) Fixing Unit

The fixing unit 17 is disposed above the rear portion of the drum cartridge 18. More specifically, the fixing unit 17 includes a heating roller 38 disposed above the scorotron charger 22, and a pressure roller 39 that contacts the heating roller 38 on an upper rear side thereof with pressure.

Hence, the heating roller 38 is disposed near an upper edge (open side edge) of the grid 24 in the scorotron charger 22.

2. Image-Forming Operation (1) Developing Operation

As shown in FIG. 2, the agitator 29 rotates to supply toner from the toner-accommodating chamber 26 of the developing cartridge 19 to the sponge roller 64 of the supply roller 33 through the communication opening 28. The supply roller 33 in turn supplies the toner onto the rubber roller 66 of the developing roller 34, at which time the toner is positively tribocharged between the sponge roller 64 and rubber roller 66.

The thickness-regulating blade 35 regulates the thickness of toner that is positively charged as the developing roller 66 rotates so that a thin layer of toner of uniform thickness is carried on the peripheral surface of the developing roller 34.

In the meantime, the scorotron charger 22 uniformly charges to e.g. +630 volts on the peripheral surface of the drum body 57 constituting the photosensitive drum 20. The peripheral surface of the drum body 57 is subsequently exposed to a laser beam L emitted from the scanning unit 16.

Here, as illustrated in FIG. 1, the laser beam L emitted from the scanning unit 16 passes over the developing cartridge 19, through the drum opening 53, and between the scorotron charger 22 and developing roller 34 with respect to the circumferential direction of the drum body 57 before impinging on the circumferential surface of the drum body 57.

Through this operation, the scanning unit 16 forms an electrostatic latent image on the circumferential surface of the drum body 57 based on image data.

Here, areas on the circumferential surface of the drum body 57 at which the electrostatic latent image was formed (i.e., the exposed areas) have a potential of +100 V, for example.

As the developing roller 34 and photosensitive drum 20 rotate in the directions indicated in FIG. 2, the electrostatic latent image formed on the circumferential surface of the drum body 57 moves into confrontation with the rubber roller 66.

At this time, a prescribed amount of toner carried on the rubber roller 66 is supplied to the latent image formed on the circumferential surface of the drum body 57 due to the developing bias. That is, the amount of toner supplied to the electrostatic latent image is controlled by a developing bias applied to the developing roller 34.

As a result, a toner image (visible image) is formed on the circumferential surface of the drum body 57 constituting the photosensitive drum 20.

(2) Sheet-Feeding and Image-Transferring Operations

As shown in FIG. 1, the rotating pickup roller 11 supplies the sheets S stacked on the sheet-supporting part 9 between the feeding roller 12 and feeding pad 13, and the rotating feeding roller 12 separates the sheets S, conveys each separated sheet S onto the feeding path 14, and supplies the sheets S one at a time to the contacting part N between drum body 57 and the roller body 60 at a prescribed timing.

Each sheet S is conveyed from beneath the contacting part N (between the drum body 57 and roller body 60) to above the same by the rotating drum body 57, at which time the toner image (visible image) carried on the circumferential surface of the drum body 57 is transferred onto the sheet S by a transfer bias applied to the transfer roller 21 (image-transferring operation).

(3) Fixing and Discharging Operations

After the toner image is transferred onto a sheet S, the sheet S passes through the paper discharge opening 55 and is conveyed to a position between the heating roller 38 and pressure roller 39.

The heating roller 38 and pressure roller 39 apply heat and pressure to the sheet S as the sheet S passes therebetween to thermally fix the toner image to the sheet S (fixing operation).

The sheet S is subsequently conveyed toward discharge rollers 40. The discharge rollers 40 discharge the sheet S onto the discharge tray 41 formed on the main casing 2 (Discharging operation).

In this way, the sheet S is supplied from the sheet-supporting part 9 and conveyed along a conveying path that has a general C-shape in a side view, passing first between the photosensitive drum 20 and transfer roller 21 (contacting part N) and next between the heating roller 38 and pressure roller 39, and subsequently being discharged onto the discharge tray 41.

3. Operation for Removing and Recovering Extraneous Matter Deposited on the Photosensitive Drum (Cleaning Operation)

During an image-forming operation on the printer 1, extraneous matter may become deposited on the circumferential surface of the drum body 57 constituting the photosensitive drum 20.

Examples of this extraneous matter include toner that remains on the circumferential surface of the drum body 57 following a transfer operation (hereinafter referred to as "residual toner") and paper dust or the like (foreign matter) deposited on the circumferential surface of the drum body 57 during a transfer operation as the sheet S passes through the contacting part N.

In the preferred embodiment, the developing roller 34 removes and recovers such extraneous matter (residual toner and paper dust, for example) during the image-forming operation. That is, the developing roller 34 supplies toner to the electrostatic latent image formed on the circumferential surface of the drum body 57 and removes and recovers extraneous matter deposited on the circumferential surface of the drum body 57 during the image-forming operation.

When the extraneous matter is residual toner, the residual toner is brought opposite the scorotron charger 22 by the rotating photosensitive drum 20 and is charged uniformly with a positive polarity. At this time, the residual toner has the generally same potential as that on the circumferential surface of the drum body 57.

When this residual toner charged to the same approximate potential as the circumferential surface of the drum body 57 is brought facing the rubber roller 66, the potential difference between the photosensitive drum 20 and the developing roller 34 causes the residual toner to migrate from the photosensitive drum 20 to the developing roller 34 and to be electrostatically retained on the circumferential surface of the rubber roller 66. As described above, the developing roller 34 electrically supplies a prescribed amount of toner to the latent image formed on the circumferential surface of the drum body 57 at this time.

Thereafter, the residual toner retained on the circumferential surface of the rubber roller 66 is either moved and collected (recovered) in the developing-cartridge frame 25 or resupplied to an electrostatic latent image on the circumferential surface of the drum body 57 as the developing roller 34 rotates.

On the other hand, if the extraneous matter is paper dust or another foreign matter, the paper dust or other foreign matter tends to acquire a more negative charge relative to residual toner in the triboelectric series and consequently is not charged with a positive polarity even after brought facing the scorotron charger 22.

However, when the rotation of the photosensitive drum 20 brings such foreign matter into confronting the rubber roller 66 of the developing roller 34, friction from the rubber roller 66 and the force of gravity causes the extraneous matter to be removed from the circumferential surface of the drum body 57 and to be retained on the circumferential surface of the rubber roller 66.

At this time, a portion of the foreign matter removed from the circumferential surface of the drum body 57 falls due to the force of gravity and is accumulated on the top surface of the lower film 36.

The foreign matter retained on the circumferential surface of the rubber roller 66 is then moved within the developing-cartridge frame 25 by the rotation of the developing roller 34 until the matter falls by the force of gravity and is recovered (stored) in the developing-cartridge frame 25.

The foreign matter that accumulates on the top surface of the lower film 36 moves forward due to gravity along the sloped top surface of the lower film 36 until arriving at the circumferential surface of the rubber roller 66. As the developing roller 34 continues to rotate, the foreign matter passes through the area of contact between the lower film 36 and rubber roller 66 and is moved back inside the developing-cartridge frame 25 (is recovered).

4. Operational Advantages (1) As shown in FIG. 2, the printer 1 is configured such that the central axis A4 of the developing roller 34 is positioned below (vertically lower than) the central axis A1 of the photosensitive drum 20. Accordingly, extraneous matter (residual toner, paper dust, and other foreign matter) deposited on the circumferential surface of the drum body 57 constituting the photosensitive drum 20 is reliably recovered on the rubber roller 66 of the developing roller 34 using gravity.

The above configuration offers a cleanerless system in which the developing roller supplies developer to the electrostatic latent image on the photosensitive drum and removes extraneous matter from the circumferential surface of the photosensitive drum while not using a cleaning device (a cleaning blade, for example) for removing the extraneous matter (including developer and foreign matter such as paper dust) that has been deposited on the circumferential surface of the photosensitive drum.

Therefore, the printer 1 can employ a cleanerless system that reliably reduces the amount of extraneous matter left on the circumferential surface of the drum body 57, thereby suppressing the occurrence of image-forming problems caused by such extraneous matter.

Hence, this configuration minimizes scratching in the circumferential surface of the drum body 57 and reliably recovers extraneous matter deposited on the same surface while enabling the printer 1 to be simplified, made more compact, and reduced in cost.

(2) As shown in FIG. 3, the transfer roller 21 is arranged with its central axis A2 positioned below (vertically lower than) the central axis A1 of the photosensitive drum 20.

Accordingly, when a sheet S passes through the contacting part N between the drum body 57 of the photosensitive drum 20 and the roller body 60 of the transfer roller 21, gravity acts on foreign matter (paper dust, for example) deposited on the surface of the sheet S facing the photosensitive drum 20 in a direction toward the sheet S.

Thus, the foreign matter is suppressed from migrating from the sheet S onto the circumferential surface of the drum body 57.

Hence, this configuration suppresses the amount of foreign matter on the sheet S that becomes deposited on the circumferential surface of the drum body 57, thereby reducing the amount of extraneous matter deposited on the circumferential surface of the drum body 57.

(3) As shown in FIG. 3, the transfer roller 21 is arranged such that the entire contacting part N is positioned below (vertically lower than) the central axis A1. In other words, both the upstream end portion of the contacting part N and the downstream end portion of the contacting part N in the rotating direction X are positioned lower than the central axis A1.

Accordingly, gravity can reliably suppress the amount of foreign matter on the sheet S that becomes deposited on the circumferential surface of the drum body 57 constituting the photosensitive drum 20.

(4) As shown in FIG. 2, the printer 1 includes the scorotron charger 22, which is configured to charge the circumferential surface of the drum body 57 constituting the photosensitive drum 20. The scorotron charger 22 is disposed above (vertically higher than) the central axis A1 and confronts but is separated from the drum body 57.

Further, the developing roller 34 and transfer roller 21 are arranged such that their respective central axes A4 and A2 are positioned lower than the central axis A1 of the photosensitive drum 20, and their respective rubber roller 66 and roller body 60 are in contact with the drum body 57 of the photosensitive drum 20.

Accordingly, the developing roller 34 and transfer roller 21 both support the photosensitive drum 20 from below.

Thus, this structure maintains a uniform positional relationship between the scorotron charger 22 disposed vertically above the central axis A1 and the drum body 57 so that the scorotron charger 22 can reliably charge the circumferential surface of the drum body 57.

Sometimes extraneous matter such as toner (residual toner) remains on the circumferential surface of the drum body 57 after the image-transferring operation.

This residual toner is charged to approximately the same potential as the circumferential surface of the drum body 57 when rotated to confront the scorotron charger 22. Therefore, the residual toner is reliably recovered on the rubber roller 66 when confronting and contacting the same, due to its potential difference with the developing roller 34.

Accordingly, this configuration can reliably recover extraneous matter deposited on the circumferential surface of the drum body 57, and particularly residual toner.

Hence, the printer 1 can reliably charge the circumferential surface of the drum body 57 and can reliably recover extraneous matter, and particularly residual toner, deposited on the circumferential surface of the drum body 57.

(5) As shown in FIG. 2, the paper discharge opening 55 is formed in the drum-accommodating section 51 between the scorotron charger 22 and transfer roller 21 in the circumferential direction of the drum body 57, and the drum opening 53 is arranged on the front portion of the drum-accommodating section 51.

In an image-forming operation, the laser beam L emitted from the scanning unit 16 passes through the drum opening 53 and between the scorotron charger 22 and the developing roller 34 with respect to the circumferential direction of the drum body 57 before exposing the circumferential surface of the drum body 57, as shown in FIG. 1.

In other words, the scorotron charger 22, transfer roller 21, and developing roller 34 can be efficiently arranged along the circumferential direction of the drum body 57 to ensure an optimal layout for a cleanerless system.

Hence, the printer 1 can be made smaller while minimizing scratching to the circumferential surface of the drum body 57 and reliably recovering extraneous matter deposited on the circumferential surface of the drum body 57.

(6) As shown in FIG. 2, the supply roller 33 is disposed on the opposite side of the developing roller 34 from the photosensitive drum 20, and the sponge roller 64 of the supply roller 33 confronts and contacts the rubber roller 66 of the developing roller 34. Accordingly, the supply roller 33 supports the developing roller 34 on the side opposite the photosensitive drum 20.

Hence, this arrangement minimizes warping in the developing roller 34 in order to maintain a constant positional relationship between the developing roller 34 and photosensitive drum 20, thereby ensuring stable contact between the rubber roller 66 and drum body 57.

As a result, the developing roller 34 can provide a stable supply of toner to the electrostatic latent images and can even more reliably recover extraneous matter that has become deposited on the circumferential surface of the drum body 57.

(7) As shown in FIG. 2, the printer 1 is provided with the lower film 36 disposed beneath the drum body 57 of the photosensitive drum 20 in a position that overlaps the central axis A1 when projected vertically.

Accordingly, any extraneous matter (paper dust or other foreign matter, for example) that falls off the circumferential surface of the drum body 57 due to gravity will accumulate on the top surface of the lower film 36.

Since the front end of the lower film 36 is in contact with the circumferential surface of the rubber roller 66 constituting the developing roller 34, extraneous matter accumulated on the lower film 36 is recovered on the circumferential surface of the rubber roller 66.

A particular feature of the lower film 36 is that its rear end portion is arranged higher than its front edge that contacts the circumferential surface of the rubber roller 66. Therefore, extraneous matter accumulating on the top surface of the lower film 36 migrates forward along the top surface of the lower film 36 until arriving at the circumferential surface of the rubber roller 66. The extraneous matter that arrives at the circumferential surface of the rubber roller 66 is retained on that surface and reliably recovered in the developing-cartridge frame 25 as the developing roller 34 is driven to rotate.

Hence, the lower film 36 and developing roller 34 reduce the occurrence of extraneous matter contaminating the region around the photosensitive drum 20, even when extraneous matter falls off the circumferential surface of the drum body 57 constituting the photosensitive drum 20 due to gravity.

5. Modifications

While the present invention has been described in detail with reference to the embodiments thereof, it would be apparent to those skilled in the art that various changes and modifications may be made therein without departing from the spirit of the invention.

In the preferred embodiment described above, the cleaning operation is implemented during the image-forming operation.

However, the cleaning operation can also be implemented alone and separate from the image-forming operation.

When the cleaning operation is executed, a developing bias is not applied to the developing roller 34. Hence, when the extraneous matter is residual toner, the potential difference between the residual toner charged by the scorotron charger 22 and the developing roller 34 will be even greater than in the preferred embodiment described above.

Thus, residual toner deposited on the circumferential surface of the drum body 57 will be even more reliably retained on the circumferential surface of the rubber roller 66 and can therefore be more reliably recovered or reused.

This variation can obtain the same operational advantages described above in the preferred embodiment.

In addition to the monochrome printer described above, the image-forming device of the present invention may be configured as a color printer.

When configured as a color printer, the image-forming device may be configured as a direct tandem color printer provided with a plurality of photosensitive bodies, and a recording medium conveying member; or as an intermediate transfer tandem color printer provided with a plurality of photosensitive bodies, an intermediate transfer body, and a transfer member.

In addition to the separable process cartridge 15 that allows the drum cartridge 18 and developing cartridge 19 to be separated from each other, as described above, the process cartridge 15 may be an integrated unit in which the drum cartridge 18 and developing cartridge 19 are integrally provided.

It is also possible to provide the photosensitive drum 20 in the main casing 2, while enabling only the developing cartridge 19 to be mounted in and removed from the main casing 2.

The developing cartridge 19 may also be configured in a frame having the developing roller 34, and a toner cartridge for accommodating toner may be detachably mounted in the frame.

Instead of the agitator 29 described above, an auger screw, a conveying belt, or another member may be used as the conveying member.

Instead of the scorotron charger 22 described above, a non-contact-type charger such as a corotron-type charger and a charger provided with a sawtooth discharge member, or a contact-type charger such as a charging roller may be used as the charger.

The image-forming device of the present invention may also be configured as a multifunction peripheral that is equipped with an image-reading unit and the like.

These variations can also obtain the same operational advantages described above in the preferred embodiment.

Note that the preferred embodiment and variations described above may also be suitably combined.

What is claimed is:

1. An image forming apparatus comprising:

a photosensitive drum configured to rotate about a first axis and having a peripheral surface;

a developing roller configured to contact the photosensitive drum and configured to supply developer to the photosensitive drum by rotating about a second axis positioned lower than the first axis in a vertical direction to form a visible image on the peripheral surface, extraneous matter on the peripheral surface being recovered only by the developing roller; and a film member overlapping the first axis when projected in the vertical direction and having a portion contacting a circumferential surface of the developing roller.

2. The image forming apparatus according to claim 1, further comprising a transfer roller configured to contact the photosensitive drum and configured to rotate about a third axis positioned lower than the first axis in the vertical direction, the transfer roller configured to transfer the visible image from the peripheral surface to a recording medium, only the developing roller and the transfer roller being in contact with the photosensitive drum.

3. The image forming apparatus according to claim 2, wherein the photosensitive drum and the transfer roller define a contact portion therebetween, the photosensitive drum being rotatable in a rotating direction such that the recording medium passes through the contact portion; and wherein the contact portion has an upstream end portion in the rotating direction positioned lower than the first axis in the vertical direction.

4. The image forming apparatus according to claim 3, wherein the contact portion in its entirety is positioned lower than the first axis in the vertical direction.

5. The image forming apparatus according to claim 2, further comprising a charger configured to charge the peripheral surface and positioned higher than the first axis in the vertical direction to confront but remain separated from the photosensitive drum.

6. The image forming apparatus according to claim 5, wherein the photosensitive drum and the transfer roller define a contact portion therebetween, the photosensitive drum being rotatable in a rotating direction such that the recording medium passes through the contact portion;

wherein the image forming apparatus further comprises an exposing device configured to emit a laser beam to the photosensitive drum to form an electrostatic latent image on the peripheral surface;

wherein the recording medium that has passed through the contact portion is discharged between the charger and the transfer roller in a peripheral direction of the photosensitive drum; and wherein the laser beam passes between the charger and the developing roller in the peripheral direction of the photosensitive drum.

7. The image forming apparatus according to claim 1, further comprising a supply roller configured to supply developer to the developing roller, the supply roller being positioned opposite to the photosensitive drum with respect to the developing roller.

8. An image forming apparatus comprising:

a photosensitive drum configured to rotate about a first axis and having a peripheral surface;

a developing roller configured to contact the photosensitive drum and configured to rotate about a second axis positioned lower than the first axis in a vertical direction; and a transfer roller configured to contact the photosensitive drum and configured to rotate about a third axis, the transfer roller being positioned higher than the second axis in the vertical direction, only the developing roller and the transfer roller being in contact with peripheral surface.

9. The image forming apparatus according to claim 8, wherein the third axis is positioned lower than the first axis in the vertical direction.

10. The image forming apparatus according to claim 8, wherein the third axis is positioned lower than the first axis in the vertical direction; and wherein the transfer roller is configured to transfer a visible image from the peripheral surface to a recording medium.

11. The image forming apparatus according to claim 8, further comprising a charger configured to charge the peripheral surface and positioned higher than the first axis in the vertical direction to confront but remain separated from the photosensitive drum.

12. The image forming apparatus according to claim 11, wherein the photosensitive drum and the transfer roller define a contact portion therebetween, the photosensitive drum being rotatable in a rotating direction such that a recording medium passes through the contact portion;

wherein the image forming apparatus further comprises an exposing device configured to emit a laser beam to the photosensitive drum to form an electrostatic latent image on the peripheral surface;

wherein the recording medium that has passed through the contact portion is discharged between the charger and the transfer roller in a peripheral direction of the photosensitive drum; and wherein the laser beam passes between the charger and the developing roller in the peripheral direction of the photosensitive drum.

13. The image forming apparatus according to claim 8, further comprising a film member overlapping the first axis when projected in the vertical direction and having a portion contacting a circumferential surface of the developing roller.

* * * * *